United States Patent [19]

Schlick et al.

[11] 4,155,032

[45] May 15, 1979

[54] CONSTANT ILLUMINATION APPARATUS

[75] Inventors: David C. Schlick, Plymouth; Truman T. Schmalzriedt, Westland, both of Mich.

[73] Assignee: Burroughs Corporation, Detroit, Mich.

[21] Appl. No.: 791,835

[22] Filed: Apr. 28, 1977

[51] Int. Cl.[2] ..... H05B 37/02; G05F 1/66

[52] U.S. Cl. ..... 315/307; 315/199; 315/205; 315/244; 315/308

[58] Field of Search ..... 315/194, 199, 205, 208, 315/244, 291, 307, 308; 307/252 VA; 323/101, 106, 119

[56] References Cited

U.S. PATENT DOCUMENTS 3,670,202 6/1972 Paine et al. ..... 315/307 X

*Primary Examiner*—Eugene R. LaRoche

*Attorney, Agent, or Firm*—William M. Hanlon; Robert L. Kaner; Carl Fissell, Jr.

[57] ABSTRACT

An apparatus that provides constant illumination in response to an AC input power source having variable magnitude. The input power passes through a full wave rectifier and is then switched by a solid state switching device having conductive and nonconductive states to a passive L-C filter. The output of the filter energizes one or more lamps to provide the illumination. A phase control circuit is responsive to a sync signal from the full wave rectifier and a feedback signal from the output of the filter and controls the phase angle conduction time of the solid state switching device at a repetition rate related to the frequency of the AC input power to provide constant illumination from the lamp.

16 Claims, 1 Drawing Figure

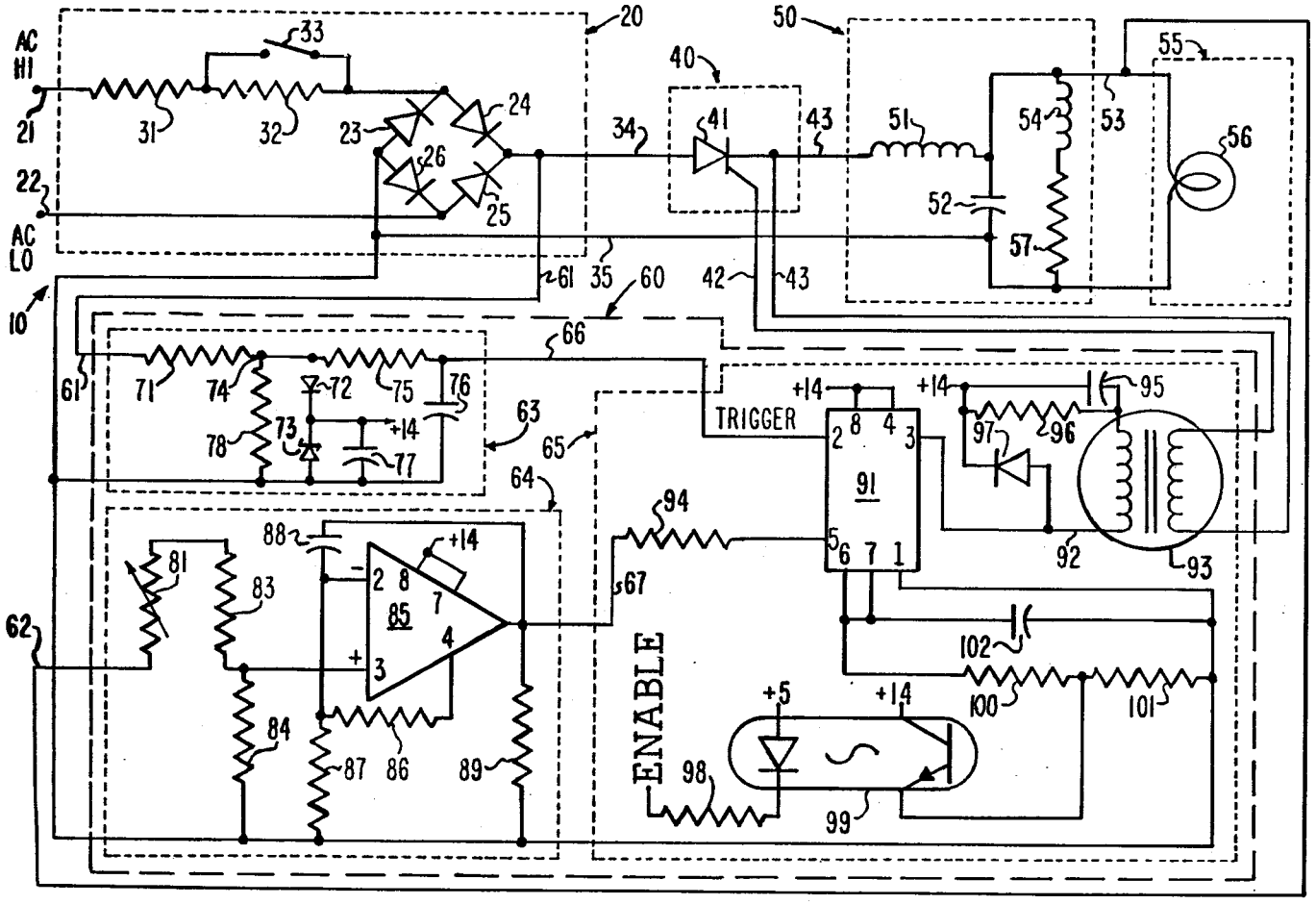
AC HI
AC LO
TRIGGER
ENABLE

CONSTANT ILLUMINATION APPARATUS

BACKGROUND OF THE INVENTION

1. Field of the Invention

This invention relates in general to illumination apparatus, and more particularly to apparatus that provides a constant illumination.

2. Description of the Prior Art

An apparatus providing constant illumination has use in an application such as photography where one may desire to make several uniform film exposures over a period of time using the same camera settings. An illumination apparatus, such as a light bulb, driven directly from an AC power line source which typically has a variable voltage magnitude will provide varying illumination.

SUMMARY OF THE INVENTION

The present invention provides an efficient apparatus for providing constant illumination in response to an AC input power source having variable magnitude.

The present invention includes a rectifier means, a switching means, a filter means, an illumination means and a phase control means. The rectifier means is operatively connected to the AC power input and provides rectified power. The switching means is operatively connected to the rectifier means and has conductive and nonconductive states for switching the rectified power. The filter means is operatively connected to the switching means and filters the power output of the switching means. The illumination means is operatively connected to the filter means and provides the illumination. The phase control means is responsive to signals from the rectifier means and the filter means, operates at a repetitive frequency that is an integer times the frequency of the AC power source, and varies the time that the switching means is in its conductive state to provide constant illumination from the illumination means.

The present invention provides constant illumination while dissipating very little internal power other than in the illumination means. The phase control means in response to the rectifier means and the filter means accurately controls the phase angle conduction time of the switch means at a repetition rate related to the frequency of the AC input power to provide constant power into the illumination means and hence constant illumination. In addition, the filter means of the present invention greatly diminishes AC power frequencies in the illumination provided by the apparatus.

Describing briefly the preferred embodiment, the rectifier means is provided by a full wave rectifier circuit. The switching means is provided by a solid state switching circuit. The filter means is provided by a passive L-C filter. The illumination means is provided by a filament lamps. The phase control means is provided by an error amplifier circuit and a variable delay circuit.

BRIEF DESCRIPTION OF THE DRAWING

The FIGURE shows a schematic diagram of the electrical circuitry of a constant illumination apparatus according to the present invention.

DESCRIPTION OF THE PREFERRED EMBODIMENT

A constant illumination appartus 10 according to the present invention is shown in the FIGURE. Such apparatus has application, for example, in microfilm photography where it may be desirable to make numerous uniform film exposures over a period of time using the same camera settings.

The apparatus 10 includes a full wave rectifier circuit 20 that is energized from an AC power line, such as for example 115 VAC at 60 Hz, via leads 21 and 22. Such a power line can typically vary in voltage magnitude from nominal by up to ±10%. Circuit 20 includes diodes 23 through 26 which are formed into a full wave bridge rectifier. The bridge rectifier is fed current via leads 21 and 22 through series resistor 31 and series thermistor 32. Series resistor 31 limits current input to the diode bridge. In addition, thermistor 32 provides an additional variable magnitude current limit during power up and is shorted out by relay contact 33 when steady state conditions are reached. Circuit 20 provides a full wave rectified voltage on conductor 34 with respect to conductor 35. Circuit 20 forms the rectifier means of the preferred embodiment.

The output of rectifier circuit 20 is input to a solid state switching device 40 via conductor 34. Switching device 40 has conductive and nonconductive states and is provided by an SCR 41 that is turned on via the leading edge of a positive voltage pulse on conductor 42 with respect to conductor 43 as will be explained further later. SCR 41 turns off when the current through the SCR is approximately zero; and such zero current value depends upon the voltage level on conductor 34 in relation to the voltage level and impedance fed back to SCR 41 via conductor 43. Switching device 40 thus provides positive voltage pulses on conductor 43 with respect to conductor 35. Switching device 40 forms the switching means of the preferred embodiment.

The output of switching device 40 is input to a passive filter 50 via conductor 43. Filter 50 includes an inductor 51 and a capacitor 52 and diminishes AC input power frequencies at its output, conductor 53 with respect to conductor 35. Filter 50 also contains relay coil 54 which activates to close relay contact 33 when steady state conditions are reached as previously described. Filter 50 forms the filter means of the preferred embodiment.

The output of filter 50 is input to a lamp 55 via conductors 53 and 35. Lamp 55 can be, for example, several filament bulbs wired in series and is represented in the drawing as a single filament bulb 56. The lamp 55 forms the illumination means of the preferred embodiment.

A phase control circuit 60 receives signals from rectifier circuit 20 and filter circuit 50 via conductors 61 and 62, respectively, and varies the conduction time of the switching device 40. Briefly, phase control circuit 60 contains a trigger circuit 63, an amplifier circuit 64, and a variable delay circuit 65. Trigger circuit 63 receives the full wave rectified voltage on conductor 61, clamps this voltage to approximately 15 volts maximum and provides it as a trigger signal on conductor 66. Amplifier circuit 64 receives the feedback signal on conductor 62, compares it to an internal voltage reference level and provides an analog control voltage on conductor 67. Variable delay circuit 65 is triggered on by the signal on conductor 66, has the length of its delay controlled by the signal on conductor 67 and provides a positive going pulse on conductor 92 with respect to conductor 43 upon completion of its delay.

More particularly with respect to trigger circuit 63, resistor 71 in conjunction with diode 72 and zener diode 73 limit the maximum voltage of the full wave rectified input at conductor 61 to approximately 15 volts at terminal 74. Resistor 75 and capacitor 76 form an R-C filter to eliminate high frequency noise. Circuit 63 thus provides at its output, conductor 66, a nominal voltage of 15 volts which momentarily drops to approximately zero volts at a repetition frequency that is twice (an integer times) the AC input power frequency. If, for example, a three phase AC power input were used, a somewhat similar trigger circuit could provide a trigger output at a repetition frequency six times the AC input power frequency. Circuit 63 also includes a capacitor 77 to provide a steady state +14 volt DC power source for the other parts of the phase control circuit 60.

More particularly with respect to amplifier circuit 64, resistors 81, 83 and 84 perform a voltage divider action on the feedback signal on conductor 62 and supply a feedback signal to amplifier 85. Resistor 81 is variable to provide initial illumination adjustment when the lamp 55 is changed. Amplifier 85 has an internal voltage reference on pin 4 with resistors 86 and 87 providing a voltage divider action that supplies a reference input to amplifier 85. The output of amplifier 85 supplies the control voltage on conductor 67. Feedback capacitor 88 determines the frequency response characteristics of amplifier 85. The amplifier circuit 64 forms the error amplifier means of the preferred embodiment.

More particularly with respect to variable delay circuit 65, a timer circuit 91 is triggered on by the rising edge of the pulse on conductor 66. In response thereto the output of timer 91 on conductor 92 changes from a logic 0 level to a logic 1 level, remains at a logic 1 level for a variable time, and then returns to a logic 0 level. The length of the logic 1 level on conductor 92 is controlled by the voltage on conductor 67 in conjunction with capacitor 102 and resistor 100, with a higher voltage on conductor 67 providing a longer delay. Upon completion of the delay, when conductor 92 changes from a logic 1 to a logic 0, pulse transformer 93 is activated and triggers SCR 41 to its conductive state. Pulse transformer 93 provides ground isolation between the phase control circuit reference, conductor 35, and the SCR reference, conductor 43. Circuit 65 also contains enable circuitry (formed by resistors 98, 100, 101, optical isolator 99 and capacitor 102) that provides ground isolation between the phase control circuit reference, conductor 35, and the enabling signal which is referenced to a separate ground. When optical isolator 99 is on, timer 91 is enabled and the lamp 55 is illuminated; and when isolator 99 is off, timer 91 is disabled and lamp 5 is turned off. Circuit 65 forms the variable delay means of the preferred embodiment.

Thus, at each zero crossing of the 60 Hz input power (a 120 Hz rate) a trigger signal on conductor 66 turns on the delay circuit 65. After a variable delay, the length of which is determined by the feedback signal from the filter circuit 50 via conductor 62, SCR 41 is triggered on and remains on until its current is zero (approximately for the remainder of the present half cycle at conductor 34). Thus, the SCR 41 turns on and off at an average frequency related to the frequency of the AC input power and the phase control circuit varies the phase angle during which the SCR 41 is conductive to provide constant illumination from the lamp 55.

Further disclosure for the circuitry that has been set forth is provided by the following various components in terms of usable types and values.

| | Value or Type |
|---|---|
| Input Power | 115 VAC ± 10%; 60 Hz |
| Bulb 56 | 8 bulbs wired in series, each bulb automotive type 1156 |
| Amplifier 85 | UA 723 |
| Timer 91 | 555 |
| Optical Isolator 99 | MOC1001 (Motorola) |
| SCR 41 | 2N3898 |
| Zener diode 73 | 14 volt |
| Pulse transformer 93 | 1:1 |
| Inductor 51 | 1.6 mh |
| Diodes | |
| 23, 24, 25, 26 | 30 amp |
| 72, 97 | IN4004 |
| Thermistor 32 | 100 ohms at 25° C. |
| Relay 54 | 24 volts DC |
| Capacitors | |
| 76 | .01 μf |
| 95, 102 | .1 μf |
| 88 | 1 μf |
| 77 | 47 μf |
| 52 | 3600 μf |
| Resistors | |
| 31 | 1 ohm |
| 98 | 330 ohm |
| 57 | 500 ohm |
| 96 | 510 ohm |
| 78, 89 | 1 K |
| 84 | 1.43K |
| 71 | 2.5K |
| 86 | 4.64K |
| 94 | 7.5K |
| 75 | 10K |
| 87 | 10.7K |
| 83 | 11.52K |
| 100 | 46.4K |
| 101 | 100K |
| Variable resistor | |
| 81 | 20K |

What is claimed is:

1. An apparatus that provides a constant illumination in response to an AC input power source having variable magnitude, comprising:

rectifier means operatively connected to said AC input power source for providing rectified power;

switching means operatively connected to said rectifier means for switching said rectified power, said switching means having conductive and nonconductive states;

filter means operatively connected to said switching means for filtering the power output of the switching means;

illumination means operatively connected to said filter means for providing said illumination; and phase control means for varying the time said switching means is in its conductive state, said phase control means being responsive to signals from said rectifier means and said filter means and operating at a frequency that is an integer times the frequency of said AC power source so as to maintain a constant level of input power to said filter means.

2. An apparatus according to claim 1 wherein said phase control means operates at a frequency no more than six times the frequency of the AC power source.

3. An apparatus according to claim 2 wherein said phase control means operates at a frequency no more than twice the frequency of the AC power surface.

4. An apparatus according to claim 2 wherein said phase control means includes a variable delay circuit means.

5. An apparatus according to claim 4 wherein said variable delay circuit means is enabled in response to the output of said rectifier means, provides a variable delay in response to the output of said filter means and then turns on said switching means.

6. An apparatus according to claim 5 wherein said switching means turns off when the current through it is zero.

7. An appartus according to claim 2 wherein said phase control means includes:

error amplifier means responsive to the output of said filter means; and variable delay circuit means for turning on said switching means, said variable delay circuit means being enabled in response to the output of said rectifier means, having its delay controlled by the output of said error amplifier means, and turning on said switching means upon completion of the delay.

8. An apparatus according to claim 7 wherein said switching means turns off when the current through it is zero.

9. An apparatus according to claim 2 wherein said rectifier means is a full-wave rectifier.

10. An apparatus according to claim 2 wherein said switching means is a solid state switching device.

11. An apparatus according to claim 2 wherein said filter means is a passive filter.

12. An apparatus according to claim 2 wherein said illumination means is a lamp.

13. An apparatus that provides a constant illumination in response to an AC input power source having variable magnitude, comprising:

a full wave rectifier operatively connected to said AC input power source for providing rectified power;

a solid state switching device operatively connected to said rectifier for switching said rectified power, said switching device having conductive and non-conductive states;

a filter operatively connected to said switching device for filtering the power output of the switching device;

a lamp for providing said illumination operatively connected to said filter; and phase control means for varying the conduction time of said switching device, said phase control means being responsive to signals from said rectifier and said filter and operating at a frequency that is twice the frequency of said AC power source so as to maintain a constant level of input power to said filter.

14. An apparatus according to claim 13 wherein said phase control means includes a variable delay circuit means.

15. An apparatus according to claim 13 wherein said phase control means comprises:

an error amplifier means responsive to the output of said filter; and a variable delay circuit means for turning on said solid state switching device, said variable delay circuit means being enabled in response to a signal from said full wave rectifier, having its delay controlled by the output of said error amplifier means, and turning on the solid state switching device upon completion of the delay.

16. An apparatus according to claim 15 wherein said solid state switching device turns off when the current through it is zero.

* * * * *